US012410616B2

(12) United States Patent
Tian et al.

(10) Patent No.: US 12,410,616 B2
(45) Date of Patent: Sep. 9, 2025

(54) REINFORCEMENT-CONFINED CIRCULAR STEEL TUBE MEMBER WITH ENHANCED END STIFFNESS

(71) Applicant: Xi'an University of Architecture and Technology, Xi'an (CN)

(72) Inventors: Limin Tian, Xi'an (CN); Chong Bai, Xi'an (CN)

(73) Assignee: Xi'an University of Architecture and Technology, xi'an (CN)

( * ) Notice: Subject to any disclaimer, the term of this patent is extended or adjusted under 35 U.S.C. 154(b) by 272 days.

(21) Appl. No.: 18/154,823

(22) Filed: Jan. 14, 2023

(65) Prior Publication Data

US 2023/0151609 A1 May 18, 2023

(30) Foreign Application Priority Data

Jun. 29, 2022 (CN) ..... 202210778323.8

(51) Int. Cl.
*E04C 3/06* (2006.01)
*E04C 3/04* (2006.01)

(52) U.S. Cl.
CPC ..... *E04C 3/06* (2013.01); *E04C 2003/0413* (2013.01); *E04C 2003/0447* (2013.01)

(58) Field of Classification Search
CPC ..... E04C 2003/0404; E04C 2003/0408; E04C 2003/0413; E04C 2003/0439; E04C 2003/0447; E04C 3/04; E04C 3/06; E04C 3/32; E04C 3/34; E04B 2001/1927; E04B 2001/1933; E04B 2001/2445; E04B 1/92; E04B 1/943; E04B 1/945
See application file for complete search history.

(56) References Cited

U.S. PATENT DOCUMENTS 2,007,597 A * 7/1935 Dean ..... F16B 9/01 228/136
2,248,278 A * 7/1941 Michelman ..... E04C 3/34 29/897.33
2016/0060886 A1* 3/2016 Cook ..... E04G 23/0225 52/514
2021/0054628 A1* 2/2021 Low ..... E04C 5/0618

FOREIGN PATENT DOCUMENTS

CN 105625595 A * 6/2016 ..... E04B 1/98
CN 216689767 U 6/2022
WO WO-2004038134 A1 * 5/2004 ..... E01F 9/65
WO WO-2017029395 A1 * 2/2017 ..... E04C 3/005

* cited by examiner

*Primary Examiner* — Theodore V Adamos

(57) ABSTRACT

A reinforcement-confined circular steel tube member with enhanced end stiffness is provided. Two ends of a first end sleeve are respectively connected to a first end plate and a first connecting annular plate. Two ends of a second end sleeve are respectively connected to a second end plate and a second connecting annular plate. A first end of a circular steel tube passes through the first connecting annular plate to be inserted into the first end sleeve and fixed to the first end plate, and a second end of the circular steel tube sequentially passes through restraint rings and the second connecting annular plate to be inserted into the second end sleeve and fixed to the second end plate. Two ends of each steel bar are respectively provided with a first limit part and a second limit part.

4 Claims, 5 Drawing Sheets

REINFORCEMENT-CONFINED CIRCULAR STEEL TUBE MEMBER WITH ENHANCED END STIFFNESS

CROSS-REFERENCE TO RELATED APPLICATIONS

This application claims the benefit of priority from Chinese Patent Application No. 202210778323.8, filed on Jun. 29, 2022. The content of the aforementioned application, including any intervening amendments thereto, is incorporated herein by reference in its entirety.

TECHNICAL FIELD

This application relates to steel structures, and more particularly to a reinforcement-confined circular steel tube member with enhanced end stiffness.

BACKGROUND

For the large-span space grid structure, the stability of key members is particularly important. If these members suffer instability, the stability of the overall structure will become extremely poor, which will cause progressive collapse, resulting in heavy casualties and serious economic losses. The existing measures, such as the double casing and local double-layer member, have large construction difficulty and large steel consumption, such that the fabricated member is heavy, and is difficult to transport.

SUMMARY

In view of the deficiencies in the prior art, this application provides a reinforcement-confined circular steel tube member with enhanced end stiffness, which is characterized by small steel consumption, convenient construction, and strong bearing capacity.

Technical solutions of this application are described as follows.

This application provides a reinforcement-confined circular steel tube member, including a first end plate, a first connecting annular plate, a first end sleeve, a second end plate, a second connecting annular plate, a second end sleeve, a circular steel tube, a plurality of restraint rings, and a plurality of reinforcing steel bars; and wherein the first end plate, the first connecting annular plate, the plurality of restraint rings, the second connecting annular plate and the second end plate are sequentially arranged; a first end of the first end sleeve is connected to the first end plate, and a second end of the first end sleeve is connected to the first connecting annular plate; a first end of the second end sleeve is connected to the second end plate, and a second end of the second end sleeve is connected to the second connecting annular plate; a first end of the circular steel tube passes through the first connecting annular plate to be inserted into the first end sleeve and fixed to the first end plate, and a second end of the circular steel tube passes through the plurality of restraint rings and the second connecting annular plate in turn to be inserted into the second end sleeve and fixed to the second end plate; the circular steel tube is in contact with an inner wall of a center through hole of each of the plurality of restraint rings; and a first end of each of the plurality of reinforcing steel bars is provided with a first limit part, and a second end of each of the plurality of reinforcing steel bars passes through the first connecting annular plate, the plurality of restraint rings, and the second connecting annular plate in turn, and is provided with a second limit part.

In an embodiment, the plurality of reinforcing steel bars are evenly distributed along a circumferential direction of the circular steel tube.

In an embodiment, each of the plurality of reinforcing steel bars is welded to the plurality of restraint rings.

In an embodiment, each of the plurality of reinforcing steel bars is a threaded reinforcing steel bar or a prestressed reinforcing steel bar.

In an embodiment, a plurality of first stiffeners are provided between the first end plate and the first connecting annular plate.

In an embodiment, the plurality of first stiffeners are evenly distributed along a circumferential direction of the first end sleeve.

In an embodiment, a plurality of second stiffeners are provided between the second end plate and the second connecting annular plate.

In an embodiment, the plurality of second stiffeners are evenly distributed along a circumferential direction of the second end sleeve.

In an embodiment, a first Belleville spring and a first washer are provided between the first end plate and the first connecting annular plate; the first Belleville spring and the washer are sleeved on the first end sleeve; and the first Belleville spring is provided between the first washer and the first end plate.

In an embodiment, a second Belleville spring and a second washer are provided between the second end plate and the second connecting annular plate; the second Belleville spring and the second washer are sleeved on the second end sleeve; and the second Belleville spring is provided between the second washer and the second end plate.

This application has the following beneficial effects.

One end of the circular steel tube passes through the first connecting annular plate to be inserted into the first end sleeve, the other end of the circular steel tube passes through the restraint rings and the second connecting annular plate in turn to be inserted into the second end sleeve. The circular steel tube is in contact with the inner wall of the center through hole of each of the plurality of restraint rings. Each reinforcing steel bar passes through the first connecting annular plate, the restraint rings and the second connecting annular plate in turn and is provided with the second limit part. The reinforcing steel bar is combined with the restraint ring to increase the lateral constraint of the circular steel tube and improve the stability of the member, thereby improving the overall structural stability and bearing capacity. The member has simple structure and small steel consumption.

Figure 1:
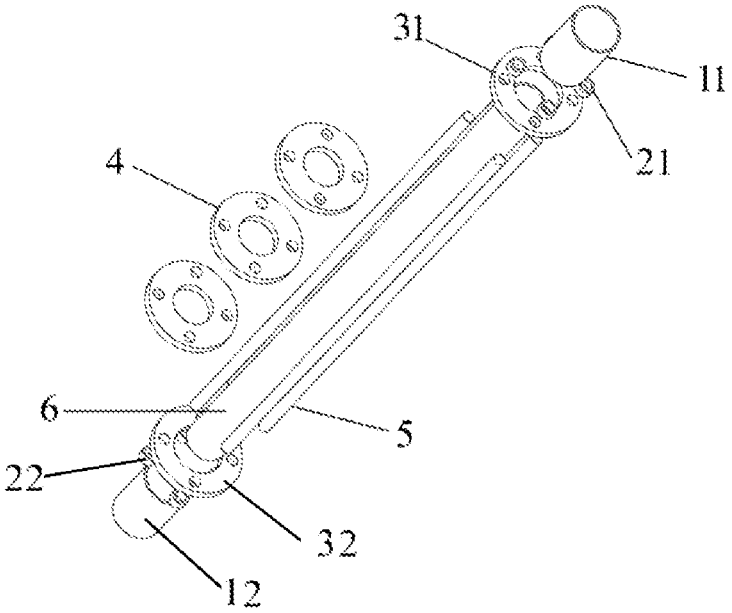
FIG. 1 is an exploded view of a reinforcement-confined circular steel tube member according to one embodiment of the present disclosure in the presence of a stiffener.
Figure 2:
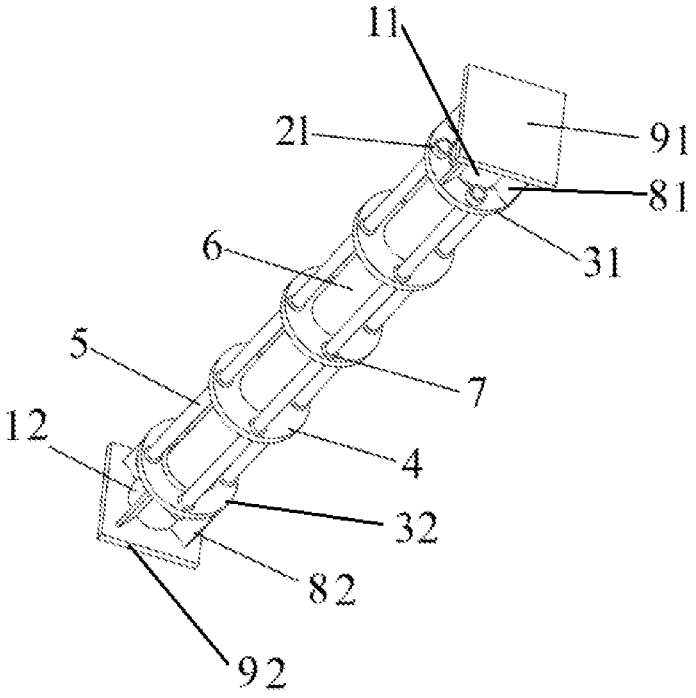
FIG. 2 is a structural diagram of the reinforcement-confined circular steel tube member according to one embodiment of the present disclosure in the presence of the stiffener.
Figure 3:
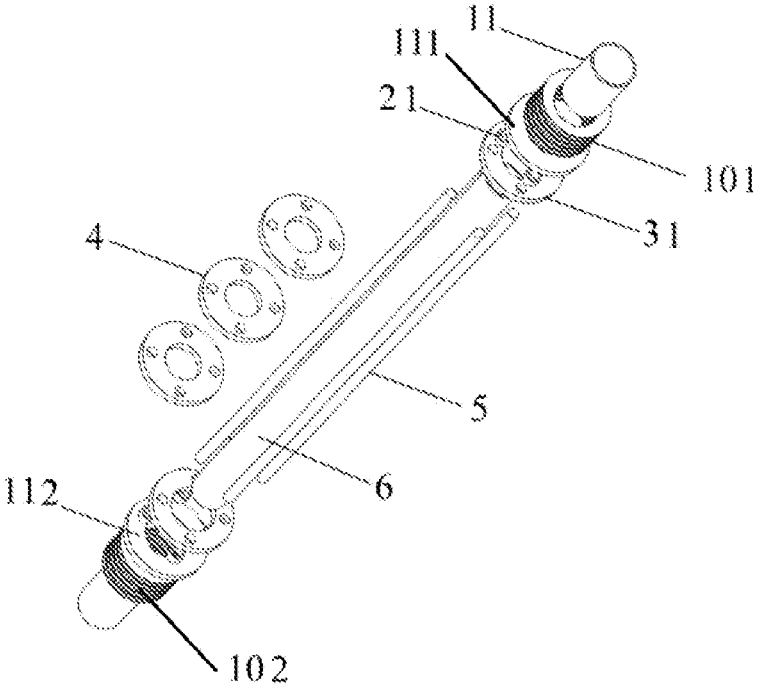
FIG. 3 is an exploded view of the reinforcement-confined circular steel tube member according to one embodiment of the present disclosure in the presence of a Belleville spring.
Figure 4:
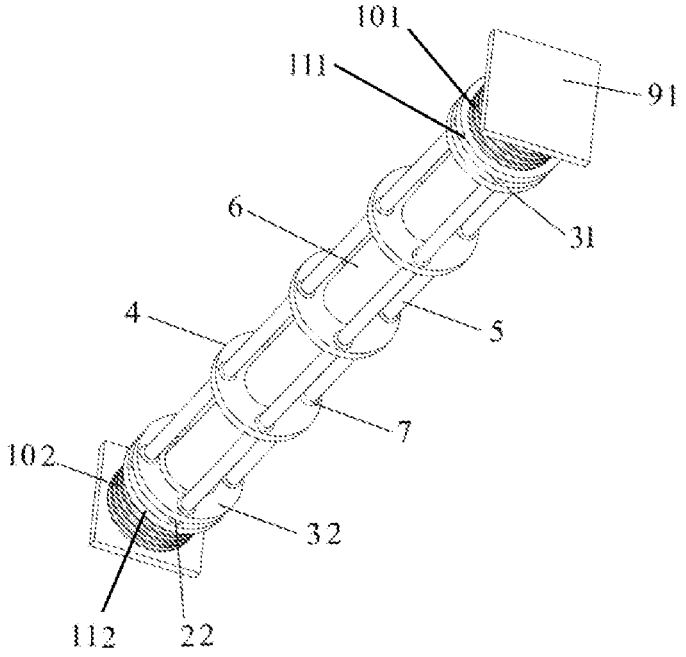
FIG. 4 is a structural diagram of the reinforcement-confined circular steel tube member according to one embodiment of the present disclosure in the presence of the Belleville spring.

In the figures: 11—first end sleeve; 12—second end sleeve; 21—first limit part; 22—second limit part; 31—first connecting annular plate; 32—second connecting annular plate; 4—restraint ring; 5—reinforcing steel bar; 6—circular steel tube; 7—welding seam; 81—first stiffener; 82—second stiffener; 91—first end plate; 92—second end plate; 101—first Belleville spring; 102—second Belleville spring; 111—first washer; and 112—second washer.

DETAILED DESCRIPTION OF EMBODIMENTS

The technical solutions of the disclosure will be described in detail below with reference to the accompanying drawings and embodiments to make those skilled in the art better understand the technical solutions disclosed herein. Obviously, described below are merely some embodiments of the disclosure, which are not intended to limit the disclosure. Further, the description of the well-known structure and techniques is omitted to avoid unnecessary confusion. For those skilled in the art, other embodiments obtained based on these embodiments without paying creative efforts should fall within the scope of the disclosure defined by the appended claims.

Embodiments of the disclosure are schematically shown in the accompanying drawings. The diagrams are not drawn in scale, where some details are enlarged, and some details are omitted for clarity. Various regions, shapes of the layers, and relative sizes and position relationships are merely illustrative. For those skilled in the art, regions/layers with different shapes, sizes, and relative positions may be designed as required.

Referring to FIGS. 1 to 4, a reinforcement-confined circular steel tube member provided herein includes a first end plate 91, a first connecting annular plate 31, a first end sleeve 11, a second end plate 92, a second connecting annular plate 32, a second end sleeve 12, a circular steel tube 6, a plurality of restraint rings 4, and a plurality of reinforcing steel bars 5.

The first end plate 91, the first connecting annular plate 31, the plurality of the restraint rings 4, the second connecting annular plate 32 and the second end plate 92 are sequentially arranged. A first end of the first end sleeve 11 is connected to the first end plate 91, and a second end of the first end sleeve 11 is connected to the first connecting annular plate 31. A first end of the second end sleeve 12 is connected to the second end plate 92, and a second end of the second end sleeve 12 is connected to the second connecting annular plate 32. A first end of the circular steel tube 6 passes through the first connecting annular plate 31 to be inserted into the first end sleeve 11 and fixed to the first end plate 91. A second end of the circular steel tube 6 passes through the plurality of restraint rings 4 and the second connecting annular plate 32 in turn to be inserted into the second end sleeve 12 and fixed to the second end plate 92. The circular steel tube 6 is in contact with an inner wall of a center through hole of each of the plurality of the restraint rings 4. A first end of each of the plurality of reinforcing steel bars 5 is provided with a first limit part 21, and a second end of each of the plurality of reinforcing steel bars 5 passes through the first connecting annular plate 31, the plurality of restraint rings 4, and the second connecting annular plate 32 in turn and is provided with a second limit part 22.

In this embodiment, the plurality of reinforcing steel bars 5 are evenly distributed along a circumferential direction of the circular steel tube 6, and each of the plurality of reinforcing steel bars 5 is welded to the plurality of restraint rings 4. The reinforcing steel bar 5 is a threaded reinforcing steel bar or a prestressed reinforcing steel bar, that is, the reinforcing steel bar 5 and the restraint ring 4 are connected by a welding seam 7.

Further, a plurality of first stiffeners 81 are provided between the first end plate 91 and the first connecting annular plate 31. The plurality of first stiffeners 81 are evenly distributed along the circumferential direction of the first end sleeve 11. A plurality of second stiffeners 82 are provided between the second end plate 92 and the second connecting annular plate 32, and the plurality of second stiffeners 82 are evenly distributed along the circumferential direction of the second end sleeve 12.

In this embodiment, a first Belleville spring 101 and a first washer 111 are provided between the first end plate 91 and the first connecting annular plate 31. The first Belleville spring 101 and the first washer 111 are sleeved into the first end sleeve 11. The first Belleville spring 101 is disposed between the first washer 111 and the first end plate 91. A second Belleville spring 102 and a second washer 112 are provided between the second end plate 92 and the second connecting annular plate 32. The second Belleville spring 102 and the second washer 112 are sleeved into the second end sleeve 12. The second Belleville spring 102 is disposed between the second washer 112 and the second end plate 92.

Figure 5:
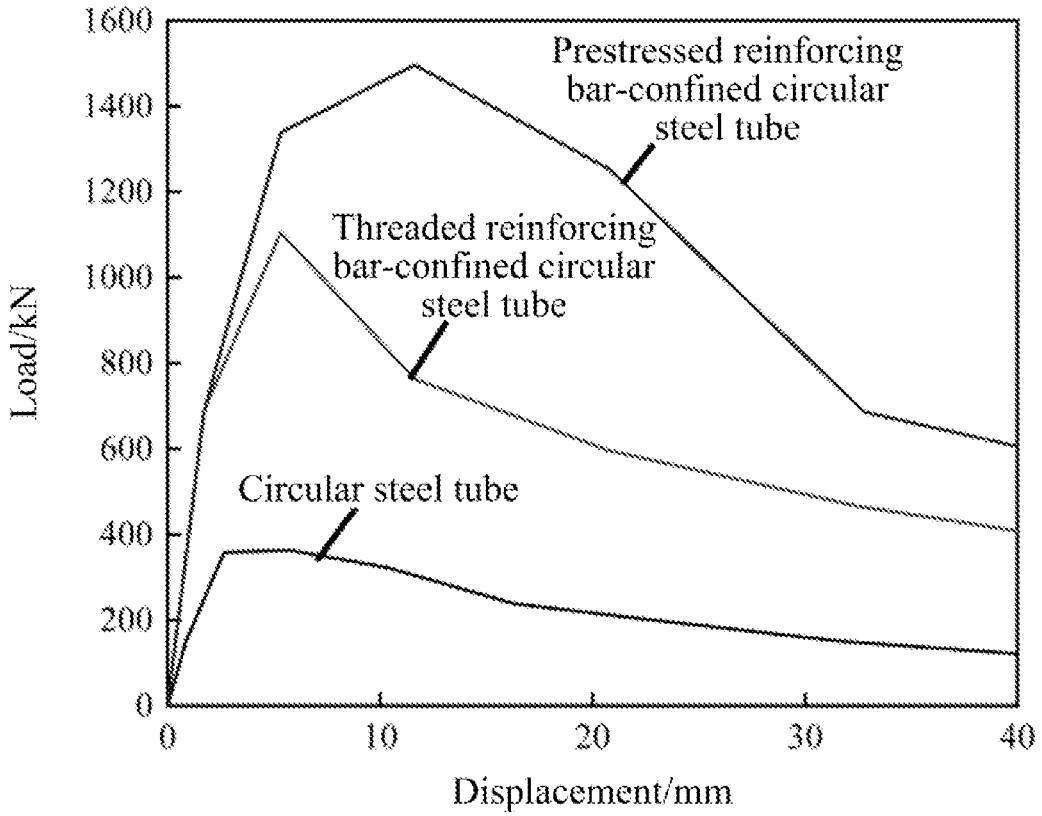
FIG. 5 shows a load-displacement curve of the circular steel tube member confined with a stiffener and a reinforcing bar according to one embodiment of the present disclosure.

Referring to FIG. 5, the reinforcing steel bar 5 combined with the restraint ring 4 increases the lateral constraint of the circular steel tube 6, thereby improving the stability of the circular steel tube member, and finally improving the stability of the overall structure. The end of the circular steel tube 6 is reinforced by stiffeners to prevent local buckling at the end and improve the stiffness of the joint or strengthened by the Belleville spring to prevent local buckling at the end and improve the stiffness of the joint, while strengthening the energy consumption at the joint.

Compared with the conventional circular steel tube, the stability bearing capacities of the circular steel tube confined with stiffening rib and reinforcement at the end and the circular steel tube confined with reinforcement are increased by 2.0 times and 3.1 times, respectively.

What is claimed is:

1. A reinforcement-confined circular steel tube member, comprising:

a first end plate;

a first connecting annular plate;

a first end sleeve;

a second end plate;

a second connecting annular plate;

a second end sleeve;

a circular steel tube;

a plurality of restraint rings; and a plurality of reinforcing steel bars;

wherein the first end plate, the first connecting annular plate, the plurality of restraint rings, the second connecting annular plate and the second end plate are sequentially arranged; a first end of the first end sleeve is connected to the first end plate, and a second end of the first end sleeve is connected to the first connecting annular plate; a first end of the second end sleeve is connected to the second end plate, and a second end of the second end sleeve is connected to the second connecting annular plate; a first end of the circular steel tube passes through the first connecting annular plate to be inserted into the first end sleeve and fixed to the first end plate, and a second end of the circular steel tube passes through the plurality of restraint rings and the second connecting annular plate in turn to be inserted into the second end sleeve, and fixed to the second end plate; the circular steel tube is in contact with an inner wall of a center through hole of each of the plurality of restraint rings; and a first end of each of the plurality of reinforcing steel bars is provided with a first limit part, and a second end of each of the plurality of reinforcing steel bars passes through the first connecting annular plate, the plurality of restraint rings, and the second connecting annular plate in turn, and is provided with a second limit part;

a first Belleville spring and a first washer are provided between the first end plate and the first connecting annular plate; the first Belleville spring and the first washer are sleeved on the first end sleeve; and the first Belleville spring is provided between the first washer and the first end plate; and a second Belleville spring and a second washer are provided between the second end plate and the second connecting annular plate; the second Belleville spring and the second washer are sleeved on the second end sleeve; and the second Belleville spring is provided between the second washer and the second end plate.

2. The reinforcement-confined circular steel tube member of claim 1, wherein the plurality of reinforcing steel bars are evenly distributed along a circumferential direction of the circular steel tube.

3. The reinforcement-confined circular steel tube member of claim 1, wherein each of the plurality of reinforcing steel bars is welded to the plurality of restraint rings.

4. The reinforcement-confined circular steel tube member of claim 1, wherein each of the plurality of reinforcing steel bars is a threaded reinforcing steel bar or a prestressed reinforcing steel bar.

* * * * *